United States Patent [19]

Schilling

[11] 4,234,627

[45] Nov. 18, 1980

[54] FABRIC CONDITIONING COMPOSITIONS

[75] Inventor: Kenneth J. Schilling, Cincinnati, Ohio

[73] Assignee: The Procter & Gamble Company, Cincinnati, Ohio

[21] Appl. No.: 765,510

[22] Filed: Feb. 4, 1977

Related U.S. Application Data

[63] Continuation of Ser. No. 636,382, Nov. 28, 1975, abandoned.

[51] Int. Cl.[2] ..... B05D 3/12; D06M 13/16

[52] U.S. Cl. ..... 427/242; 252/8.7; 252/8.75; 252/8.8; 252/8.9; 252/135; 252/174.11; 252/174.13

[58] Field of Search ..... 427/242; 252/316, 8.8 AJ, 252/8.8 AO, 8.8 AM, 8.9, 8.7, 8.75, 135, 174.11, 174.13

[56] References Cited

U.S. PATENT DOCUMENTS

| | | | |
|---|---|---|---|
| 2,461,043 | 2/1949 | Eisen | 57/157 R |
| 3,632,296 | 1/1972 | Pandell et al. | 8/115.5 |
| 3,686,025 | 8/1972 | Morton | 252/8.6 X |
| 3,798,179 | 3/1974 | Hellyer | 252/535 |
| 3,870,542 | 3/1975 | Ida et al. | 8/79 X |
| 3,896,033 | 7/1975 | Grimm | 252/8.8 |
| 3,936,537 | 2/1976 | Baskerville, Jr. et al. | 427/242 |

FOREIGN PATENT DOCUMENTS

| | | |
|---|---|---|
| 2408636 | 9/1974 | Fed. Rep. of Germany . |
| 1313697 | 4/1973 | United Kingdom . |

*Primary Examiner*—Evan K. Lawrence

*Attorney, Agent, or Firm*—Ronald L. Hemingway; Richard C. Witte

[57] ABSTRACT

Fabric conditioning compositions suitable for effectively imparting fabric conditioning agents to fabrics during the home laundering operation via friable microcapsules containing such agents. A method for delivery of the agents is also provided.

13 Claims, No Drawings

FABRIC CONDITIONING COMPOSITIONS

This is a continuation of application Ser. No. 636,382 filed Nov. 28, 1975, now abandoned.

BACKGROUND OF THE INVENTION

The present invention relates to the treatment of fabrics with conditioning agents (primarily perfume) during the home laundering operation. The invention herein utilizes friable microcapsules to carry the fabric conditioning agent to the fabrics being treated. Capsules containing the conditioning agent are made to attach themselves to fabrics in either the presoak bath or washing machine and are thereafter ruptured by manipulation of the fabrics to thereby release the conditioning agent.

The home laundering operation can provide an opportunity to treat fabrics being laundered with a variety of materials which impart some desirable benefit or quality to the fabrics during laundering. At each stage of the laundering operation (presoaking, washing, rinsing, drying) fabrics are, to varying degrees, found in contact with water which can provide the medium for delivery of fabric conditioning agents.

Delivery of fabric conditioning agents to fabrics during the laundering operation is not, however, accomplished without certain difficulties. Surfactants are generally employed during the presoaking and washing steps for the purpose of removing materials (soil) from the fabrics. Simultaneous deposition onto fabrics of fabric conditioning agents can, therefore, prove troublesome. While some of these problems can be overcome by conditioning fabrics in the automatic dryer (See, for example, Gaiser; U.S. Pat. No. 3,442,692; issued May 6, 1969), it is nevertheless exceptionally difficult to achieve efficient deposition in the dryer of those fabric conditioning agents such as perfume which are volatile and therefore susceptible to rapid evaporation in the dryer heat.

Attempts have been made to improve the efficiency of conditioning agent fabric deposition during the laundering process. For example, the copending U.S. patent application of Haug et al; Ser. No. 520,186; filed Nov. 1, 1974, involves the use of particulate sorbitan ester material as a fabric conditioning agent for use in home laundering. The copending U.S. patent application of Webb et al; Ser. No. 516,052; filed Oct. 18, 1974, involves the use of particulate starch material to deliver perfume to fabrics in the automatic dryer. In spite of these developments, there is a continuing need for methods and compositions which are suitable for efficiently and effectively delivering conditioning agents to fabrics during the home laundering operation.

Accordingly, it is an object of the present invention to provide granular presoaking/washing compositions which can deliver effective amounts of fabric conditioning agents to fabrics being laundered.

It is a further object of the present invention to provide an improved method for delivering fabric conditioning agents and especially volatile agents such as perfume to fabrics during the presoak or wash stage of the laundering process.

It has been surprisingly discovered that by utilizing particular types of conditioning agent-containing friable microcapsules in combination with certain types of capsule transfer agents, the above-enumerated objectives can be attained. Furthermore, methods and compositions can be realized which are unexpectedly superior to similar methods and compositions of the prior art. Athough treatment of fabrics with microcapsules is known (See, for example, Ida et al.; U.S. Pat. No. 3,870,542; issued Mar. 11, 1975; Bedenk et al.; U.S. patent application Ser. No. 586,448; filed June 12, 1975, and Pandell et al.; U.S. Pat. No. 3,632,296; issued Jan. 4, 1972), such prior art fabric treatment has generally required utilization of large numbers of microcapsules to provide effective capsule delivery. Furthermore, the prior art has not provided adequate methods or compositions suitable for microcapsule treatment of fabrics during the presoaking/washing stage of the home laundering operation.

SUMMARY OF THE INVENTION

The present invention relates to granular presoaking-/washing compositions comprising:

(A) from about 3% to 20% by weight of a granular fabric treatment mixture, the granules within said mixture comprising (i) water-insoluble, friable microcapsules varying in size from about 5 to 500 microns, each microcapsule consisting essentially of (a) a liquid core containing fabric conditioning agent; and (b) a solid thin polymeric shell completely surrounding said core; said shell having an average thickness ranging between about 0.1 and 50 microns; and (ii) a substantially water-insoluble, fabric substantive capsule transfer agent having a melting point between about 40° C. and 150° C; said capsule transfer agent surrounding each microcapsule;

the weight ratio of microcapsules to capsule transfer agent within each granule of the fabric treatment mixture ranging between about 0.002:1 and 2000:1; and (B) from about 5% to 90% by weight of a presoaking-/washing adjuvant selected from the group consisting of water-soluble detersive surfactants, detergency builders and mixtures of water-soluble detersive surfactants and detergency builders.

Additionally, the present invention relates to a method of treating fabrics with compositions as described above.

DETAILED DESCRIPTION OF THE INVENTION

The present invention involves the home laundry application to fabrics of friable microcapsules containing fabric conditioning agent followed by manipulation of the treated fabrics so as to rupture the microcapsules. The microcapsules are applied to fabrics via a fabric treatment mixture which contains the microcapsules and a capsule transfer agent surrounding the microcapsules in a granular presoak/laundry composition.

Microcapsules

The microcapsules useful in the present invention comprise a liquid core containing one or more fabric conditioning agents and a thin polymeric shell completely surrounding the liquid core. By encapsulating the fabric conditioning agent (in liquid form), the fabric conditioning agent is protected during the laundering operation and is thus preserved for most efficient application to fabrics. Conditioning agent is actually applied to the fabrics when the microcapsules rupture. This can occur either during the automatic drying step of the home laundering operation or can actually occur after the fabrics are laundered and while they are being used.

For purposes of the present invention a "fabric conditioning agent" is any substance which improves or modifies the chemical or physical characteristics of the fabric being treated therewith. Examples of suitable fabric conditioning agents include perfumes, elasticity improving agents, flame proofing agents, pleating agents, antistatic agents, softening agents, soil proofing agents, water repellent agents, crease proofing agents, acid repellent agents, antishrinking agents, heat proofing agents, coloring material, brighteners and fluoroscers.

The most preferred fabric conditioning agent for use in the present invention is perfume. Perfume is an especially suitable fabric conditioning agent for use herein since its volatility generally creates special problems when it is used in fabric treating situations.

The perfume which can be used in the liquid cores of the microcapsules can be any odoriferous material and will be selected according to the desires of the formulator. In general terms, such perfume materials are characterized by a vapor pressure above atmospheric pressure at ambient temperatures. The perfume materials employed herein will most often be liquid at ambient temperatures, but also can be solids such as the various camphoraceous perfumes known in the art. A wide variety of chemicals are known for perfumery uses, including materials such as aldehydes, ketones, esters, and the like. More commonly, naturally-occurring plant and animal oils and exudates comprising complex mixtures of various chemical components are known for use as perfumes, and such materials can be used herein. The perfumes herein can be relatively simple in their composition, or can comprise highly sophisticated, complex mixtures of natural and synthetic chemical components, all chosen to provide any desired odor.

Typical perfumes herein can comprise, for example, woody/earthy bases containing exotic materials such as sandalwood oil, civet, patchouli oil, and the like. The perfumes herein can be of a light, floral fragrance, etc., rose extract, violet extract, and the like. The perfumes herein can be formulated to provide desirable fruity odors, e.g., lime, lemon, orange, and the like. In short, any material which exudes a pleasant or otherwise desirable odor can be used in the liquid microcapsule core to provide a desirable odor when applied to fabrics. Preferred, perfumes include musk ambrette, musk ketone, musk tibetine, musk xylol, aurantiol, ethyl vanillin and mixtures thereof.

The fabric conditioning agent will frequently be in liquid form and can be used as the sole material in the microcapsule core. Fabric conditioning agents which are normally solid can also be employed in the microcapsule core if they are admixed with a liquefying agent such as a solvent. Water or any organic solvent can be used to liquify normally solid fabric conditioning agents for use in the microcapsule core provided such a solvent is chemically compatible with the microcapsule shell material described hereinafter.

The shell material surrounding the liquid, conditioning agent-containing core to form the microcapsule can be any suitable polymeric material which is impervious to the materials in the liquid core and the materials which may come in contact with the outer surface of the shell. The microcapsule shell wall can be composed of a wide variety of polymeric materials including polyurethane, polyolefin, polyamide, polyester, polysaccharide, silicone resins and epoxy resins. Many of these types of polymeric microcapsule shell materials are further described and exemplified in Ida et al; U.S. Pat. No. 3,870,542; issued Mar. 11, 1975, the disclosure of which is incorporated herein by reference.

Highly preferred materials for the microcapsule shell wall are the aminoplast polymers comprising the reactive products of urea and aldehyde, e.g. formaldehyde. Such materials are those which are capable of acid condition polymerization from a water-soluble prepolymer state. Such prepolymers are made by reacting urea and formaldehyde in a formaldehyde:urea molar ratio of from about 1.2:1 to 2.6:1. Thiourea, cyanuramide, guanidine, N-alkyl ureas, phenols, sulfonamides, anilines and amines can be included in small amounts as modifiers for the urea. Polymers formed from such prepolymer materials under acid conditions are water-insoluble and can provide the requisite capsule friability characteristics as described more fully hereinafter.

Microcapsules having the liquid cores and polymer shell walls as described above can be prepared by any conventional process which produces capsules of the requisite size, friability and water-insolubility. Generally, such methods as coacervation and interfacial polymerization can be employed in known manner to produce microcapsules of the desired characteristics. Such methods are described in Ida et al; U.S. Pat. No. 3,870,542; issued Mar. 11, 1975; Powell et al; U.S. Pat. No. 3,415,758; issued Dec. 10, 1968 and Anthony; U.S. Pat. No. 3,041,288; issued June 26, 1962. All of these patents are incorporated herein by reference.

Microcapsules made from the preferred urea-formaldehyde shell materials can be made by an interfacial polymerization process described more fully in Matson; U.S. Pat. No. 3,516,941; issued June 23, 1970; incorporated herein by reference. By that process an aqueous solution of a urea-formaldehyde precondensate (methylol urea) is formed containing from about 3% to 30% by weight of the precondensate. Water-insoluble liquid core material (e.g., perfume) is dispersed throughout this solution in the form of microscopically-sized discrete droplets. While maintaining solution temperature between 20° C. and 90° C., acid is then added to catalyze polymerization of the dissolved urea-aldehyde precondensate. If the solution is rapidly agitated during this polymerization step, shells of water-insoluble, urea-formaldehyde polymer form around and encapsulate the dispersed droplets of liquid core material. Preferred microcapsules for use in the present invention are thereby produced.

No matter how the microcapsules utilized herein are produced, it is essential that the microcapsules vary in size between about 5 microns and 500 microns, preferably between about 10 microns and 100 microns. Furthermore it is essential that the capsules utilized in the present invention have an average shell thickness ranging from about 0.1 to 50 microns, preferably from about 0.4 to 4 microns.

The microcapsules of the present invention must also be friable in nature. Friability refers to the propensity of the microcapsules to rupture or break open when subjected to direct external pressures or shear forces. For purposes of the present invention, the microcapsules utilized are "friable" if, while attached to fabrics treated therewith, they can be ruptured by the forces encountered when the capsule-containing fabrics are tumbled in an automatic laundry dryer or are manipulated by being worn or handled. Microcapsules made with the above-described shell materials will be "friable" if they fall within the essential capsule size and shell thickness limitations provided above.

Capsule Transfer Agent

Attachment of the above-described microcapsules to the fabrics being treated therewith is facilitated by surrounding the microcapsules with a particular type of capsule transfer agent. Capsule transfer agents employed in the present invention are those substantially water-insoluble materials which are fabric substantive and which have a melting point with the range of from about 40° C. to 150° C., preferably within the range of from about 49° C. to 105° C. By "substantially water-insoluble" herein is meant a water insolubility of 1% by weight, or less, at 30° C.

Especially suitable capsule transfer agents are those cationic and nonionic organic materials which are generally employed as conventional fabric softening agents during the washing, rinsing or drying cycles of the household laundry process. Materials of this type generally have the requisite fabric substantivity for use herein.

Suitable cationic capsule transfer agents include any of the cationic (including imidazolinium) compounds listed in Morton; U.S. Pat. No. 3,686,025; issued Aug. 22, 1972, incorporated herein by reference. Such materials are well known in the art and include, for example, the quaternary ammonium salts having at least one, preferably two, $C_{10}$–$C_{20}$ fatty alkyl sustituent groups; alkyl imidazolinium salts wherein at least one alkyl group contains a $C_8$–$C_{25}$ carbon "chain"; the $C_{12}$–$C_{20}$ alkyl pyridinium salts, and the like.

Preferred cationic softeners herein include the quaternary ammonium salts of the general formula $R^1R^2R^3R^4N^+,X^-$, wherein groups $R^1$,$R^2$,$R^3$ and $R^4$ are, for example, alkyl, and $X^-$is an anion, e.g., halide, methylsulfate, and the like, with the chloride and methylsulfate salts being preferred. Especially preferred capsule transfer agents are those wherein $R^1$ and $R^2$ are each $C_{12}$–$C_{20}$ fatty alkyl and $R^3$ and $R^4$ are each $C_1$–$C_4$ alkyl. The fatty alkyl groups can be mixed, i.e., the mixed $C_{14}$–$C_{18}$ coconutalkyl and mixed $C_{16}$–$C_{18}$ tallowalkyl quaternary compounds. Alkyl groups $R^3$ and $R^4$ are preferably methyl.

Exemplary quaternary ammonium softeners herein include ditallowalkyldimethylammonium methylsulfate, ditallowalkyldimethylammonium chloride, dicoconutalkyldimethylammonium methylsulfate, and dicoconutalkyldimethylammonium chloride.

Nonionic capsule transfer agents include a wide variety of materials including sorbitan esters, fatty alcohols and their derivatives, diamine compounds and the like. One preferred type of nonionic capsule transfer agent comprises the esterified cyclic dehydration products of sorbitol, i.e., sorbitan ester. Sorbitol, itself prepared by catalytic hydrogenation of glucose, can be dehydrated in well-known fashion to form mixtures of cyclic 1,4- and 1,5-sorbitol anhydrides and small amounts of isosorbides. (See Brown; U.S. Pat. No. 2,322,821; issued June 29, 1943) The resulting complex mixtures of cyclic anhydrides of sorbitol are collectively referred to herein as "sorbitan". It will be recognized that this "sorbitan" mixture will also contain some free uncyclized sorbitol.

Sorbitan ester capsule transfer agents useful herein are prepared by esterifying the "sorbitan" mixture with a fatty acyl group in standard fashion, e.g., by reaction with a fatty ($C_{10}$–$C_{24}$) acid or fatty acid halide. The esterification reaction can occur at any of the available hydroxyl groups, and various mono-, di-, etc., esters can be prepared. In fact, complex mixtures of mono-, di-, tri, and tetra-esters almost always result from such reactions, and the stoichiometric ratios of the reactants can simply be adjusted to favor the desired reaction product. The sorbitan mono-esters and di-esters are preferred for use as the capsule transfer agent in the present invention, but all such esters are useful.

The foregoing complex mixtures of esterified cyclic dehydration products of sorbitol (and small amounts of esterified sorbitol) are collectively referred to herein as "sorbitan esters". Sorbitan mono- and di-esters of lauric, myristic, palmitic, stearic and behenic acids are particularly useful herein for facilitating transfer of the microcapsules to fabrics being treated. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters, and mixtures thereof, which are essentially water-insoluble and which have fatty hydrocarbyl "tails", are useful capsule transfer agents in the context of the present invention.

The preferred alkyl sorbitan ester capsule transfer agents herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono- and di-esters and the mixed tallowalkyl sorbitan mono- and di-esters. The tri- and tetra-esters of sorbitan with lauric, myristic, palmitic, stearic and behenic acids, and mixtures thereof, are also preferred herein.

Sorbitan esters of the foregoing type are more fully described and exemplified in the copending application of Wahib N. Zaki; Ser. No. 543,607; filed Jan. 23, 1975. This application is incorporated herein by reference.

Another useful type of nonionic capsule transfer agent encompasses the substantially water-insoluble compounds chemically classified as fatty alcohols. Mono-ols, di-ols and poly-ols having the requisite melting points and water-insolubility properties set forth above are useful herein. Such alcohol-type capsule transfer materials also include the mono- and di-fatty glycerides which contain at least one "free" OH group.

All manner of water-insoluble, high melting alcohols (including mono and di-glycerides), are useful herein, inasmuch as all such materials are fabric substantive and tend to facilitate attachment of the microcapsules herein to fabric surfaces. Of course, it is desirable to use those materials which are colorless, so as not to alter the color of the fabrics being treated. Toxicologically acceptable materials which are safe for use in contact with skin should be chosen.

A preferred type of unesterified alcohol useful herein includes the higher melting members of the so-called fatty alcohol class. Although once limited to alcohols obtained from natural fats and oils, the term "fatty alcohols" has come to mean those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed as the capsule transfer agent in the instant invention encompasses various esters of polyhydric alcohols. Such "ester-alcohol" materials which have a melting point within the range recited herein and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. In particular, di-glycerides containing two $C_8$–$C_{20}$, preferably $C_{10}$–$C_{18}$, alkyl groups in the molecule are useful capsule transfer agents.

Non-limiting examples of ester-alcohols useful herein include: glycerol-1,2-dilaurate; glycerol-1,3-dilaurate; glycerol-1,2-myristate; glycerol-1,3-dimyristate; glycerol-1,2-dipalmitate; glycerol-1,3-dipalmitate; glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Mono- and di-ether alcohols, especially the $C_{10}$–$C_{18}$ di-ether alcohols having at least one free —OH group, also fall within the definition of alcohols useful as capsule transfer agents herein. The ether-alcohols can be prepared by the classic Williamson ether synthesis. As with the ester-alcohols, the reaction conditions are chosen such that at least one free, unetherified —OH group remains in the molecule.

Ether-alcohols useful herein include glycerol-1,2-dilauryl ether; glycerol-1,3-distearyl ether; and butane tetra-ol-1,2,3-trioctanyl ether.

Yet another type of nonionic capsule transfer agent useful herein encompasses the substantially water-insoluble diamine compounds and diamine derivatives. The diamine capsule transfer agents are selected from the group consisting of particular alkylated and acylated diamine compounds.

Useful diamine compounds have the general formula:

$$R_1-\overset{\overset{R_2}{|}}{N}-(CH_2)_n-\overset{\overset{R_3}{|}}{N}-R_4$$

wherein $R_1$ is an alkyl or acyl group containing from about 12 to 20 carbon atoms; $R_2$ and $R_3$ are hydrogen or alkyl of from about 1 to 20 carbon atoms and $R_4$ is hydrogen, $C_{1-20}$ alkyl or $C_{12-20}$ acyl. At least two or $R_2$, $R_3$ and $R_4$ are hydrogen or alkyl containing 1 to 3 carbon atoms, and n is from 2 to 5.

Nonlimiting examples of such alkylated diamine compounds include:

$C_{16}H_{33}—N(CH_3)—(CH_2)_3—N(CH_3)_2$ $C_{18}H_{37}—N(CH_3)—(CH_2)_2—N(C_2H_5)_2$ $C_{12}H_{25}—N(CH_3)—(CH_2)_3—HN—C_{12}H_{25}$ $C_{12}H_{25}—N(C_2H_5)—(CH_2)_3—N(C_3H_7)_2$ $R_{Tallow}—NH—(CH_2)_3—N(C_2H_5)_2$ $C_{20}H_{41}—N(CH_3)—(CH_2)_2—N(CH_3)_2$ $C_{15}H_{31}—N(C_2H_5)—(CH_2)_3—NH_2$ $C_{18}H_{37}—NH—(CH_2)_3—HN—CH_3$ $C_{16}H_{33}—NH—(CH_2)_3—HN—C_{16}H_{33}$ $R_{Tallow}—N(CH_3)—(CH_2)_3—N(C_2H_5)_2$ $C_{16}H_{33}N(CH_3)—(CH_2)_5—N(C_2H_5)_2$ $C_{12}H_{25}N(C_2H_5)—(CH_2)_2—N(C_3H_7)_2$ and $C_{14}H_{29}N(CH_3)—(CH_2)_3—CH_3)N—C_8H17$ wherein in the above formulas $R_{Tallow}$ is the alkyl group derived from tallow fatty acid.

Other examples of suitable alkylated diamine compounds include N-tetradecyl, N'-propyl-1,3-propanediamine; N-eicosyl,N,N',N'-triethyl-1,2-ethane-diamine and N-octadecyl,N,N',N'-tripropyl-1,3-propane-diamine.

Examples of suitable acylated diamine capsule transfer agents include $C_{13-20}$ amido amine derivatives such as those marketed under the trade name CB 6532 by Sandoz Colors and Chemicals.

The capsule transfer agents of the present invention can and preferably do comprise mixtures of the above-described types of substantially water-insoluble, fabric substantive fatty compounds. For the granular presoaking/washing compositions of the present invention highly preferred capsule transfer agents include the $C_{10-22}$ alkyl mono-, di-, tri- and tetrasorbitan esters, mixtures of these sorbitan esters and mixtures of these sorbitan esters with di- $C_{10-22}$ alkyl dimethyl quaternary ammonium salts such that sorbitan ester/quaternary weight ratios vary between 1:4 and 4:1. The $C_{10-22}$, preferably $C_{14-18}$, alkyl tri- and tetra-sorbitan esters are the most preferred capsule transfer agents for use in presoaking/washing composition. Other preferred mixtures include mixtures of $C_{10}$ to $C_{22}$ alkyl sorbitan tri- and tetra-esters and $C_{14}$ to $C_{20}$ fatty alcohols with $C_{12}$ to $C_{20}$ dialkyl, dimethylammonium salts in a total nonionic/quaternary salt ratio of from about 1:4 to 4:1. Also 2:1 mixtures of sorbitan tristearate with ditallow dimethylammonium methylsulfate and 1:1:1 mixtures of sorbitan tristearate, tallow alcohol and ditallowmethylammonium methylsulfate.

Capsule Application to Fabrics

The above-described microcapsules are applied to fabrics via a fabric treatment mixture which contains the microcapsules and the capsule transfer agent or agents. Within such a fabric treatment mixture, the weight ratio of microcapsules to capsule transfer agent generally varies between about 0.002:1 and 2000:1, preferably between about 0.008:1 and 3:1. The fabric treatment mixture also contains a detersive surfactant or a detergency builder or mixtures of surfactant and builder as noted hereinbelow.

Within the fabric treatment mixture, it is preferred that the capsule transfer agent completely surround or envelop the individual microcapsules. This is generally accomplished by thoroughly admixing the microcapsules with the capsule transfer agent in some form of liquid medium.

Any conventional coating technique can be utilized including the preferred spray-on processes or fluidized bed coating methods.

By utilizing the capsule transfer agent completely surrounding the microcapsules, it is possible to deliver satisfactory numbers of microcapsules to fabric surfaces without utilizing extremely large numbers of capsules.

Granular Presoaking/Washing Composition

The fabric application of the microcapsule-containing fabric treatment mixture takes place during the presoaking or washing steps of the home laundering operation. Particular granular presoaking and/or washing compositions can be formulated which are especially useful for carrying out the capsule-application step of the instant fabric treatment method.

Water-soluble surfactants used in the presoaking-/washing compositions herein include any of the common anionic, nonionic, ampholytic and zwitterionic detersive surfactants well known in the detergency arts. Mixtures of surfactants can also be employed herein. More particularly, the surfactants listed in Booth, U.S. Pat. No. 3,717,630, issued Feb. 20, 1973, and Kessler et al; U.S. Pat. No. 3,332,880, issued July 25, 1967, each incorporated herein by reference, can be used herein. Non-limiting examples of surfactants suitable for use in the instant presoaking/washing compositions are as follows:

Water-soluble salts of the higher fatty acids, i.e., "soaps" are useful as the anionic surfactant herein. This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present presoaking/washing compositions are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099, and 2,477,383, incorporated herein by reference.

Other anionic surfactant compounds useful herein include the sodium alkyl glyceryl ether sulfonates, especially those ethers or higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic surfactants herein include the water-soluble salts of esters of α-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Preferred water-soluble anionic organic surfactants herein include linear alkyl benzene sulfonates containing from about 11 to 14 carbon atoms in the alkyl group; the tallow range alkyl sulfates; the coconut range alkyl glyceryl sulfonates; and alkyl ether sulfates wherein the alkyl moiety contains from about 14 to 18 carbon atoms and wherein the average degree of ethoxylation varies between 1 and 6.

Specific preferred anionic surfactants for use herein include: sodium linear $C_{10}$–$C_{12}$ alkyl benzene sulfonate; triethanolamine $C_{10}$–$C_{12}$ alkyl benzene sulfonate; sodium tallow alkyl sulfate; sodium coconut alkyl glyceryl ether sulfonate; and the sodium salt of a sulfated condensation product of tallow alcohol with from about 3 to about 10 moles of ethylene oxide.

It is to be recognized that any of the foregoing anionic surfactants can be used separately herein or as mixtures.

Nonionic surfactants include the water-soluble ethoxylates of $C_{10}$–$C_{20}$ aliphatic alcohols and $C_6$–$C_{12}$ alkyl phenols. Many nonionic surfactants are especially suitable for use as suds controlling agents in combination with anionic surfactants of the type disclosed herein.

Semi-polar surfactants useful herein include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivaties of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water-solubilizing group.

When the present granular conditioning compositions are used as presoaking or wash additive compositions in conjunction with other commercially available laundry detergent products, the detersive surfactant component generally comprises from about 0% to 7% by weight of the compositions, preferably from about 2% to 6% by weight. When the present granular fabric conditioning compositions are to be used as the sole detergent product during the laundering process, the detersive surfactant component generally comprises from about 5% to about 25%, preferably from about 10% to 20% by weight of the composition.

The presoaking/washing instant granular compositions can also comprise those detergency builders commonly taught for use in laundry compositions. Useful builders herein include any of the conventional inorganic and organic water-soluble builder salts, as well as various water-insoluble and so-called "seeded" builders.

Inorganic detergency builders useful herein include, for example, water-soluble salts of phosphates, pyrophosphates, orthophosphates, polyphosphates, phosphonates, carbonates, bicarbonates, borates and silicates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference. Sodium tripolyphosphate is an especially preferred, water-soluble inorganic builder herein.

Non-phosphorus containing sequestrants can also be selected for use herein as detergency builders. Specific examples of non-phosphorus, inorganic builder ingredients include water-soluble inorganic carbonate, bicarbonate, borate and silicate salts. The alkali metal, e.g., sodium and potassium, carbonates, bicarbonates, borates (Borax) and silicates are particularly useful herein.

Water-soluble, organic builders are also useful herein. For example, the alkali metal, ammonium and substituted ammonium polyacetates, carboxylates, polycarboxylates, succinates, and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorous builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in the copending application of Benjamin, Ser. No. 248,546, filed Apr. 28, 1972, the disclosure of which is incorporated herein by reference.

Specific example of materials capable of forming the water-insoluble reaction product include the water-soluble salts of carbonates, bicarbonates, sequicarbonates, silicates, aluminates and oxalates. The alkali metal, especially sodium, salts of the foregoing materials are preferred for convenience and economy.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, invention; Bauman, issued Jan. 28, 1969, incorporated herein by reference.

The complex aluminosilicates, i.e., zeolite-type materials, are useful presoaking/washing adjuvants herein in that these materials soften water, i.e., remove $Ca^{++}$ hardness. Both the naturally occurring and synthetic "zeolites", especially zeolite A and hydrated zeolite A materials, are useful for this builder/softener purpose. A description of zeolite materials and a method of preparation appears in Milton, U.S. Pat. No. 2,882,243, issued Apr. 14, 1959, incorporated herein by reference. The co-pending application of Corkill, et al, entitled DETERGENT COMPOSITION, Ser. No. 450,266, filed Mar. 11, 1974, describes the use of hydrated synthetic zeolites as builders and is also incorporated herein by reference.

When the present granular conditioning compositions are used as presoaking or wash additive compositions in conjunction with other commercially available laundry detergent products, the detergency builder component generally comprises from about 30% to 90% by weight of the compositions, preferably from about 50% to 75% by weight. When the present granular fabric conditioning compositions are to be used as the sole detergent product during the laundering process, the detergency builder component generally comprises from about 25% to about 75%, preferably from about 30% to 50% by weight of the composition.

In addition to the above-described essential surfactant or builder presoaking/washing adjuvants, the present granular compositions can optionally contain a wide variety of other conventional detergency adjuncts. Representative materials of this type include, for example, the various anti-caking agents, filler materials, optical brighteners, anti-spotting agents, dyes, perfumes, and the like. These adjunct materials are commonly used as minor components (e.g., 0.1% to 5% wt.) in compositions of the present type.

Highly preferred optional additives herein include various bleaches commonly employed in pre-soak, laundry additive and detergent compositions. Such bleaches can include, for example, the various organic peroxyacids such as peradipic acid, perphthalic acid, diperphthalic acid diperazelaic acid and the like. Inorganic bleaches, i.e. persalts including such materials as sodium perborate, sodium perborate tetra-hydrate, urea peroxide, and the like, can be employed in the compositions herein. Bleaches are commonly used in the instant granular compositions at a level of from about 1% to about 45% by weight.

An especially preferred bleaching agent for use herein is sodium perborate tetrahydrate, at an effective concentration of from about 10% to about 30% by weight of the total composition.

Various detergency enzymes well known in the art for their ability to degrade and aid in the removal of various soils and stains can also be employed in the present granular compositions. Detergency enzymes are commonly used at concentrations of from about 0.1% to about 1.0% by weight of such compositions.

Typical enzymes include the various proteases, lipases, amylases, and mixtures thereof, which are described to remove a variety of soils and stains from fabrics.

The granular presoaking/washing compositions can be prepared simply by admixing conventional detergent granules containing surfactant and/or builder with the coated microcapsule granules. The microcapsule granules are themselves prepared by coating the microcapsules with capsule transfer agent by any conventional coating means as noted hereinbefore.

Fabric Manipulation

Once microcapsules containing fabric conditioning agent have been attached to fabrics being treated, it is, of course, necessary to manipulate the treated fabrics in a manner sufficient to rupture the microcapsules and thereby release the conditioning agent. Microcapsules of the type utilized herein have friability characteristics such that the ordinary fabric manipulation encountered in the home is sufficient to rupture at least a portion of the attached microcapsules.

Microcapsules applied from the granular compositions of the present invention are generally ruptured by fabric manipulation which occurs when the treated fabrics are worn or used. A significant number of attached microcapsules can be broken by the normal forces encountered when treated garments are worn. For fabric articles which are not worn, the normal household handling operations such as ironing, folding, crumpling, etc., can serve as fabric manipulation sufficient to rupture the attached microcapsules. Some rupturing also occurs prior to the time when the fabrics are worn through the drying of the fabrics in an automatic clothes dryer operating at from about 38° C. to about 115° C.

The methods and compositions of the present invention are illustrated by the following examples:

EXAMPLE I

A presoaking detergent composition of the following formulation is prepared:

| COMPONENT | | WT. % |
|---|---|---|
| Sodium Perborate Tetrahydrate | | 25% |
| Sodium Tripolyphosphate | | 30% |
| Borax | | 8% |
| Tallow Alcohol Ethoxylate[1] | | 3% |
| Spray-Dried Detergent Granules[2] | | 25% |
| Enzyme[3] | | 0.3% |
| Fabric Treatment Granules[4] | | 6% |
| Perfume-Containing Microcapsules | Capsule/Coating Weight Ratio = | 0.02:1 |
| Sorbitan Ester Coating | | |
| Water & Miscellaneous | | Balance |
| | | 100% |

[1]Tallow alcohol condensed with an average of 22 ethylene oxide groups
[2] Comprising in spray-dried granule form, 10%-$C_{12}$ linear alkyl benzyne sulfonate; 20%-sodium carbonate; 20%-sodium silicate; balance-sodium sulfate and water
[3]Alkalase (Novo) and protease (Miles Laboratories)
[4]Prepared by coating microcapsules (average diameter 40 microns) containing a perfume core and a urea-formaldehyde shell (average shell thickness 1.5 microns). Microcapsules are coated with a mixture of $C_{10}$—$C_{22}$ alkyl sorbitan esters, the major portion comprising tri- and tetra-esters, and ditallowalkyldimethylammonium methyl sulfate quaternary, at a sorbitan ester: quaternary weight ratio of 4:1.

The microcapsules of the fabric treatment granule component are prepared by the interfacial polymerization procedure outlined in Matson; U.S. Pat. No. 3,516,941; issued June 23, 1970. The fabric treatment granules themselves are prepared by spraying the microcapsules with a comelt of the sorbitan ester/quaternary capsule transfer agent in a rotating drum. The capsules are coated to the extent that 60 mesh granules are formed.

The complete Example I composition is prepared by simply dry mixing the requisite granular ingredients until a homogeneous granular product is secured.

The composition of Example I (½ cup) is used to presoak soiled articles of clothing for a period of three hours in five gallons of water at a temperature of 38° C. Thereafter, the articles are removed and laundered using a commercial anionic detergent. The clothing articles are rinsed, spin-dried in a standard automatic washing machine and are thereafter placed in an automatic laundry dryer. The dryer is operated at an average temperature of 50° C. for a period of 40 minutes. Upon removal of the fabrics from the dryer, noticeable presoak perfume odor can be detected. Even greater presoak perfume odor can be detected, however, when the treated articles of clothing are manipulated during the course of ordinary wearing.

What is claimed is:

1. A granular laundry presoaking/washing composition comprising:
   (A) from about 3% to 20% by weight of a granular fabric treatment mixture, the granules within said mixture comprising
      (i) water-insoluble, friable microcapsules varying in size from about 5 to 500 microns, each microcapsule consisting essentially of
         (a) a liquid core containing fabric conditioning agent; and
         (b) a solid thin polymeric shell completely surrounding said core; said shell having an average thickness ranging between about 0.1 and 50 microns; and
      (ii) a substantially water-insoluble, fabric substantive capsule transfer agent having a melting point between about 40° C. and 150° C.; said capsule transfer agent surrounding each microcapsule;
   the weight ratio of microcapsules to capsule transfer agent within each granule of the fabric treatment mixture between about 0.002:1 and 2000:1; and
   (B) from about 5% to 90% by weight of a presoaking-/washing adjuvant selected from the group consisting of water-soluble detersive surfactants, detergency builders and mixtures of water-soluble detersive surfactants and detergency builders.

2. A composition in accordance with claim 1 wherein
   (A) the microcapsule shell wall material is selected from the group consisting of polyurethanes, polyolefins, polyamides, polyesters, polysaccharides, silicone resins, epoxy resins and aminoplast polymers derived from urea and aldehydes;
   (B) the fabric conditioning agent is a perfume; and
   (C) the capsule transfer agent is selected from the group consisting of cationic and nonionic organic materials and mixtures thereof.

3. A composition in accordance with claim 2 wherein the presoaking/washing adjuvant comprises from about 5% to 25% by weight of the composition of a water-soluble detersive surfactant and from about 30% to 50% by weight of the composition of a detergency builder.

4. A composition in accordance with claim 2 wherein the presoaking/washing adjuvant comprises
   (A) from about 0% to 7% by weight of the composition of a detersive surfactant selected from the group consisting of linear alkyl benzene sulfonates having from 11 to 14 carbon atoms in the alkyl group, alkylsulfates having from 12 to 20 carbon atoms in the alkyl group, alkyl glyceryl sulfonates having from 8 to 18 carbon atoms in the alkyl group, alkyl ether sulfates having from 14 to 18 carbon atoms in the alkyl group and an average degree of ethoxylation between 1 and 6, the water-soluble ethoxylates of aliphatic alcohols containing from 10 to 20 carbon atoms and mixtures of these surfactants; and (B) from about 30% to 90% by weight of a detergency builder selected from the group consisting of water-soluble phosphates, pyrophosphates, orthophosphates, polyphosphates, carbonates, bicarbonates, borates, silicates, polyacetates, carboxylates, polycarboxylates and succinates.

5. A composition in accordance with claim 4 wherein the capsule transfer agent is a nonionic fabric softening agent selected from the group consisting of the $C_{14}$ to $C_{18}$ alkyl sorbitan tri- and tetra-esters.

6. A composition in accordance with claim 4 wherein the capsule transfer agent is a water-insoluble mixture of nonionic and cationic fabric softeners, said mixtures being selected from the group consisting of (a) mixtures of $C_{10}$ to $C_{22}$ alkyl sorbitan tri- and tetra-esters with $C_{12}$ to $C_{22}$ dialkyl, dimethylammonium salts in a sorbitan ester/quaternary salt weight ratio of from about 1:4 to 4:1, and (b) mixtures of $C_{10}$ to $C_{22}$ alkyl sorbitan tri- and tetra-esters and $C_{14}$ to $C_{20}$ fatty alcohols with $C_{12}$ to $C_{20}$ dialkyl, dimethyl ammonium salts in a total nonionic/quaternary salt weight ratio of from about 1:4 to 4:1.

7. A composition in accordance with claim 4 wherein the capsule transfer agent is selected from the group consisting of 2:1 mixtures of sorbitan tristearate with ditallowdimethylammonium methylsulfate and 1:1:1 mixtures of sorbitan tristearate, tallow alcohol and ditallowdimethylammonium methylsulfate.

8. A composition in accordance with claim 2 wherein (A) the microcapsule shell wall material is a urea-formaldehyde polymer having an average shell wall thickness of from about 0.4 to 4.0 microns;

(B) the microcapsules vary in size between 10 and 100 microns; and (C) the weight ratio of microcapsules to capsules transfer agent varies between 0.008:1 and 3:1.

9. A composition in accordance with claim 2 which additionally contains a detergent adjuvant selected from the group consisting of a peroxygen bleaching agent present to the extent of from about 1% to 45% by weight a detergency enzyme component present to the extent of from about 0.1% to 1% by weight and mixtures of said bleaching agent and enzyme components.

10. A process for conditioning fabrics comprising the steps of:

(A) contacting said fabrics in an aqueous bath with an effective amount of a composition comprising:

1. from about 3% to 20% by weight of a granular fabric treatment mixture, the granules within said mixture comprising (i) water-insoluble; friable microcapsules varying in size from about 5 to 500 microns, each microcapsule consisting essentially of (a) a liquid core containing fabric conditioning agent; and (b) a solid thin polymeric shell completely surrounding said core; said shell having an average thickness ranging between about 0.1 and 50 microns; and (ii) a substantially water-insoluble, fabric substantive capsule transfer agent having a melting point between about 40° C. and 150° C.; said capsule transfer agent surrounding each microcapsule;

the weight ratio of microcapsules to capsule transfer agent within each granule of the fabric treatment mixture ranging between about 0.002:1 and 2000:1; and 2. from about 5% to 90% by weight of a presoaking/washing adjuvant selected from the group consisting of water-soluble detersive surfactants, detergency builders and mixtures of water-soluble detersive surfactants and detergency builders; and (B) manipulating said fabrics in an automatic clothes dryer at a temperature of from about 38° C. to about 100° C.

11. A process according to claim 10 wherein the fabric conditioning agent is a perfume.

12. A process according to claim 11 wherein the capsule transfer agent is a nonionic fabric softening agent selected from the group consisting of the $C_{14}$ to $C_{18}$ alkyl sorbitan tri- and tetra-esters.

13. A process according to claim 11 wherein the presoaking/washing adjuvant comprises:

(A) from about 0% to 7% by weight of the composition of a detersive surfactant selected from the group consisting of linear alkyl benzene sulfonates having from 11 to 14 carbon atoms in the alkyl group, alkylsulfates having from 12 to 20 carbon atoms in the alkyl group, alkyl glyceryl sulfonates having from 8 to 18 carbon atoms in the alkyl group, alkyl ether sulfates having from 14 to 18 carbon atoms in the alkyl group and an average degree of ethoxylation between 1 and 6, the water-soluble ethoxylates of aliphatic alcohols containing from 10 to 20 carbon atoms and mixtures of these surfactants; and (B) from about 30% to 90% by weight of a detergency builder selected from the group consisting of water-soluble phosphates, pyrophosphates, orthophosphates, polyphosphates, carbonates, bicarbonates, borates, silicates, polyacetates, carboxylates, polycarboxylates and succinates.

* * * * *